US012342865B2

(12) United States Patent
Luo et al.

(10) Patent No.: US 12,342,865 B2
(45) Date of Patent: Jul. 1, 2025

(54) ATOMIZING CORE AND ELECTRONIC ATOMIZING DEVICE

(71) Applicant: SHENZHEN SMOORE TECHNOLOGY LIMITED, Shenzhen (CN)

(72) Inventors: Hongliang Luo, Shenzhen (CN); Kaiwen Luo, Shenzhen (CN); Congwen Xiao, Shenzhen (CN)

(73) Assignee: SHENZHEN SMOORE TECHNOLOGY LIMITED, Shenzhen (CN)

( * ) Notice: Subject to any disclaimer, the term of this patent is extended or adjusted under 35 U.S.C. 154(b) by 454 days.

(21) Appl. No.: 17/572,824

(22) Filed: Jan. 11, 2022

(65) Prior Publication Data

US 2022/0218030 A1 Jul. 14, 2022

(30) Foreign Application Priority Data

Jan. 11, 2021 (CN) ..... 202120058904.5

(51) Int. Cl.

| | |
|---|---|
| ***A24F 40/46*** | (2020.01) |
| ***A24F 40/20*** | (2020.01) |
| ***A24F 40/48*** | (2020.01) |

(52) U.S. Cl.

CPC ..... *A24F 40/46* (2020.01); *A24F 40/20* (2020.01); *A24F 40/48* (2020.01)

(58) Field of Classification Search

None

See application file for complete search history.

(56) References Cited

U.S. PATENT DOCUMENTS

2020/0397052 A1* 12/2020 Pelz ..... A24F 40/46

FOREIGN PATENT DOCUMENTS

| | | | | |
|---|---|---|---|---|
| CN | 109259331 A | | 1/2019 | |
| CN | 111109666 A | * | 5/2020 | |
| CN | 111436664 A | | 7/2020 | |
| WO | WO-2016169115 A1 | * | 10/2016 | ..... A24F 47/00 |

OTHER PUBLICATIONS

Notification of Correction for Chinese Application No. 202120058904.5 mailed Sep. 10, 2021.

* cited by examiner

*Primary Examiner* — Michael H. Wilson
*Assistant Examiner* — Michael T Fulton
(74) *Attorney, Agent, or Firm* — Dorsey & Whitney LLP

(57) ABSTRACT

The present disclosure relates to an atomizing core and an electronic atomizing device. The atomizing core includes: a base including an atomizing surface; and a heating element disposed on the base, and capable of atomizing liquid on the atomizing surface. The heating element includes a first surface that is in a thickness direction thereof and attached to the base. The heating element is provided with liquid guiding channels that are kept at a set distance from the first surface.

12 Claims, 4 Drawing Sheets

ATOMIZING CORE AND ELECTRONIC ATOMIZING DEVICE

CROSS-REFERENCE TO RELATED APPLICATION

This application claims to the priority of Chinese Patent Application No. 202120058904.5, filed on Jan. 11, 2021, the entire contents of which is incorporated herein by reference.

TECHNICAL FIELD

The present disclosure relates to the field of atomizing technology, in particular, to an atomizing core and an electronic atomizing device including the atomizing core.

BACKGROUND

An atomizing core generally includes a base and a heating element. The heating element is disposed on the base and used to atomize liquid on the base to form an aerosol that can be inhaled by a user. However, for conventional atomizing cores, for example, the heating element is usually dry burned, which causes the temperature of the aerosol to be higher, and thus causes oral burns to the user, causes the aerosol to have a certain burnt smell. For another example, the heating element is usually over-permeated by the e-liquid, which results in the e-liquid splashing phenomenon on the heating element, such that the utilization rate of the e-liquid is low, which causes the e-liquid to be wasted, and also causes the temperature of the aerosol to be lower and causes the fragrance to have an insufficient sense level.

SUMMARY

According to various embodiments, an atomizing core and an electronic atomizing device are provided.

An atomizing core includes: a base including an atomizing surface; and a heating element disposed on the base, and capable of atomizing liquid on the atomizing surface. The heating element includes a first surface that is in a thickness direction thereof and attached to the base. The heating element is provided with liquid guiding channels that are kept at a set distance from the first surface.

In one of the embodiments, the heating element further includes a second surface that is spaced apart from the first surface in the thickness direction thereof. The second surface and the first surface face oppositely. The liquid guiding channels extend through the second surface and are in communication with outside.

In one of the embodiments, the liquid guiding channels are micro holes. A cross section of each of the micro holes is in a shape of circle, ellipse, rectangle, or regular polygon.

In one of the embodiments, the micro holes are arranged on at least part of the second surface along a plurality of rows of parallel lines.

In one of the embodiments, orthographic projections of any two adjacent rows of micro holes in a column direction do not completely overlap with each other. The column direction is a direction perpendicular to the parallel lines.

In one of the embodiments, the liquid guiding channels are elongated grooves. A plurality of the elongated grooves are arranged at intervals on at least part of the second surface.

In one of the embodiments, a thickness of the heating element is in a range from 10 μm to 150 μm. A depth of the liquid guiding channel is in a range from 5 μm to 120 μm.

In one of the embodiments, the heating element further includes a first side surface and a second side surface that are arranged oppositely. The first surface is connected between the first side surface and the second side surface. Both ends of the liquid guiding channel extend through the first side surface and the second side surface respectively.

In one of the embodiments, the atomizing core further includes: a first electrode connected to one end of the heating element; and a second electrode connected to the other end of the heating element.

In one of the embodiments, the heating element is directly attached to the atomizing surface.

In one of the embodiments, the atomizing surface is provided with a groove. The heating element is entirely or partially accommodated in the groove.

An electronic atomizing device includes the atomizing core according to any one of the embodiments.

An embodiment of the present disclosure can achieve the following technical effects. The liquid guiding channel is kept at a set distance from the first surface, and the liquid guiding channel does not extend to the lower part of the heating element adjacent to the first surface, such that the lower part of the heating element is in a "fully dense state". The upper part of the heating element away from the first surface is provided with the liquid guiding channel, such that the upper part of the heating element is in a "fully permeable state". Therefore, the lower part in the "fully dense state" and the upper part in the "fully permeable state" are connected to form the heating element in the "semi-permeable state". In this way, the wettability of the heating element is neither too high nor too low, so as to ensure that the heating element has reasonable wettability, and can generate an appropriate temperature, preventing the generation of the aerosol with excessively high temperature and the burning smell due to dry burning, and avoiding that the heating element is separated from the base and even fused due to dry burning, which improves the service life and safety of the heating element. In addition, it can be ensured that the temperature of the aerosol is appropriate, neither too hot nor too cold. Furthermore, the fragrance of the aerosol has a certain sense level. The liquid guiding channel can further increase the resistance of the heating element. Under the same input power, the heating element can generate more heat, and the e-liquid atomized per unit time is increased, thereby increasing the concentration of the aerosol. In addition, the liquid guiding channel can cause the heating element to have reasonable wettability, so that the thickness of the heating element can be appropriately increased to increase its structural strength, preventing the heating element from being warped or wrinkled under thermal stress, avoiding the heating element from being fused due to dry burning, and eliminating the generation of toxic gases, further improving the service life and safety of the heating element.

DETAILED DESCRIPTION OF THE EMBODIMENTS

In order to facilitate the understanding of the present disclosure, the present disclosure will be described in a more comprehensive manner with reference to the relevant drawings. Preferred embodiments of the disclosure are shown in the accompanying drawings. However, the present disclosure can be implemented in many different forms and is not limited to the embodiments described herein. On the contrary, providing these embodiments is to make the disclosure of the disclosure more thorough and comprehensive.

It should be noted that when an element is referred to as being "fixed to" another element, it can be directly on another element or there may be an intermediate element therebetween. When an element is considered to be "connected to" another element, it can be directly connected to another element or there may be an intermediate element therebetween at the same time. The terms "inner", "outer", "left", "right", and the like used herein are for illustrative purposes only and are not intended to be the only embodiments.

Figure 1:
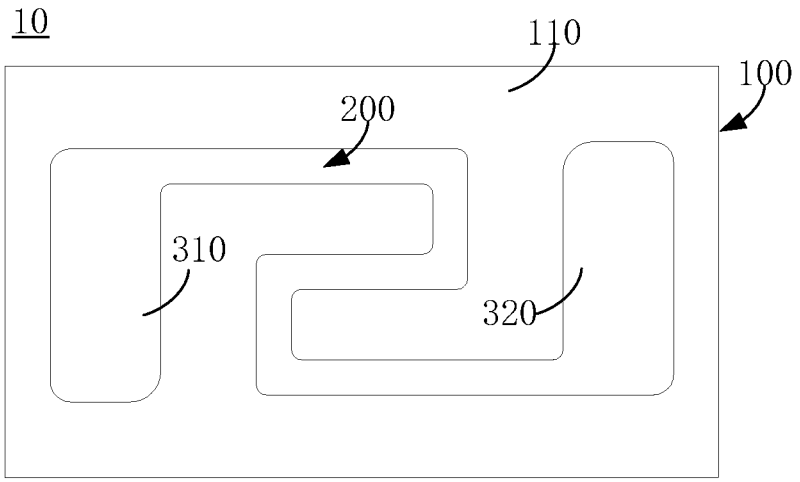
FIG. 1 is a plane schematic view of an atomizing core according to an embodiment.
Figure 2:
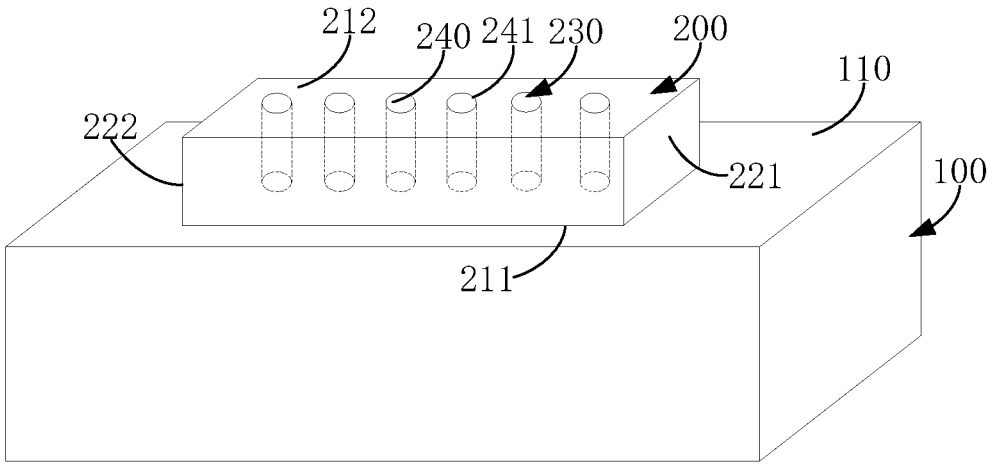
FIG. 2 is a partial perspective schematic view of the atomizing core shown in FIG. 1 according to a first example.
Figure 3:
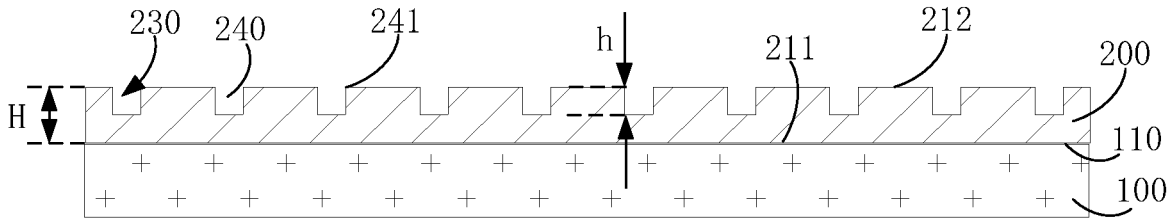
FIG. 3 is a partial cross-sectional schematic view of the atomizing core shown in FIG. 1.

Referring to FIGS. 1, 2, and 3, an electronic atomizing device according to an embodiment of the present disclosure includes an atomizer and a power supply. The atomizer is provided with a liquid storage cavity and includes an atomizing core 10. The atomizing core 10 includes a base 100, a heating element 200, a first electrode 310, and a second electrode 320. The base 100 can be made of a porous ceramic material. The base 100 has a certain porosity, so that liquid in the liquid storage cavity can be transferred through the base 100 and temporarily stored in the base 100. The liquid in the liquid storage cavity can be a liquid aerosol generating substrate such as e-liquid. The base 100 has an atomizing surface 110. The liquid temporarily stored in the base 100 can be transferred to the atomizing surface 110.

The heating element 200 is disposed on the base 100. The first electrode 310 can be electrically connected to one end of the heating element 200 and a positive electrode of the power supply. The second electrode 320 can be electrically connected to the other end of the heating element 200 and a negative electrode of the power supply. In this way, the power supply can supply power to the heating element 200 through the first electrode 310 and the second electrode 320. The heating element 200 may be directly attached to the atomizing surface 110. That is, the heating element 200 is directly spread on the atomizing surface 110. A groove may further be provided on the atomizing surface 110. The heating element 200 is entirely or partially accommodated in the groove. When the heating element 200 is entirely accommodated in the groove, the atomizing surface 110 may be exactly flush with a surface of the heating element 200, or the atomizing surface 110 is higher than the surface of the heating body 200 by a certain distance. When the power supply supplies power to the heating element 200 through the first electrode 310 and the second electrode 320, the heating element 200 converts electrical energy into heat. The liquid on the atomizing surface 110 can absorb the heat generated by the heating element 200 to be atomized to form an aerosol that can be inhaled by a user. When the first electrode 310 and the second electrode 320 have a film-like structure, the first electrode 310 and the second electrode 320 can be directly attached to the atomizing surface 110, or can be accommodated in the groove formed on the atomizing surface 110. When the first electrode 310 and the second electrode 320 have a linear structure, the first electrode 310 and the second electrode 320 can also directly extend through the base 100.

In some embodiments, the atomizer and the power supply can be in a detachable connection. For example, the atomizer is detachably fixed to the power supply through a magnetic attraction connection, a threaded connection, or a snap connection. Therefore, the atomizer can be a disposable consumable, and the power supply can be recycled multiple times. When the e-liquid in the atomizer is completely consumed, the atomizer whose e-liquid has been consumed can be detached from the power supply and discarded. Then, a new atomizer filled with the e-liquid can be remounted on the power supply. In other embodiments, the atomizer and the power supply can be in a non-detachable connection.

The atomizing core 10 can be manufactured by the following methods. For example, firstly, a viscous electrode slurry and a heating slurry are printed on the atomizing surface 110 of the base 100 by screen printing, and then the base 100 with the electrode slurry and the heating slurry are sintered, so that the viscous electrode slurry forms the first electrode 310 and the second electrode 320 attached to the atomizing surface 110, and the viscous heating slurry forms the heating element 200 attached to the atomizing surface 110. Finally, the atomizing core 10 is formed. For another example, firstly, the heating element 200, the first electrode 310, and the second electrode 320 that are connected together and in a solid state are manufactured, and then, the heating element 200, the first electrode 310, and the second electrode 320 that are in a solid state are placed in a die cavity of an injection mold. A porous ceramic slurry for forming the base 100 is injected into the die cavity of the injection mold, and then cooled and cured, the porous ceramic slurry for forming the base 100 will be transformed into a blank body. Then, the blank body attached with the heating element 200, the first electrode 310, and the second electrode 320 is taken out of the die cavity and sintered, so that the blank body is transformed into the shaped base 100, as such, the atomizing core 10 can be formed as well.

Referring to FIGS. 1, 2, and 3, in some embodiments, the heating element 200 has a substantially curved film-like structure. A thickness H of the heating element 200 can be in a range from 10 μm to 150 μm, for example, can specifically be 10 μm, 20 μm, 80 μm, or 150 μm, etc. The heating element 200 may be made of a metal alloy such as iron-chromium alloy, iron-chromium-aluminum alloy, iron-chromium-nickel alloy, chromium-nickel alloy, titanium alloy, stainless steel alloy, or Karma alloy. The heating element 200 has a first surface 211, a second surface 212, a first side surface 221, and a second side surface 222. The first surface 211 is spaced apart from the second surface 212 in a thickness direction of the heating element 200, and the first surface 211 and the second surface 212 face oppositely. Both the first side surface 221 and the second side surface 222 are arranged in a width direction of the heating element 200, and the first side surface 221 and the second side surface 222 face oppositely. The first surface 211 is connected between one end of the first side surface 221 and one end of the second side surface 222, and the second surface 212 is connected between the other end of the first side surface 221 and the other end of the second side surface 222. For example, both the first side surface 221 and the second side surface 222 are located at an upper side of the first surface 211, and both the first side surface 221 and the second side surface 222 are located at a lower side of the second surface 212.

Figure 4:
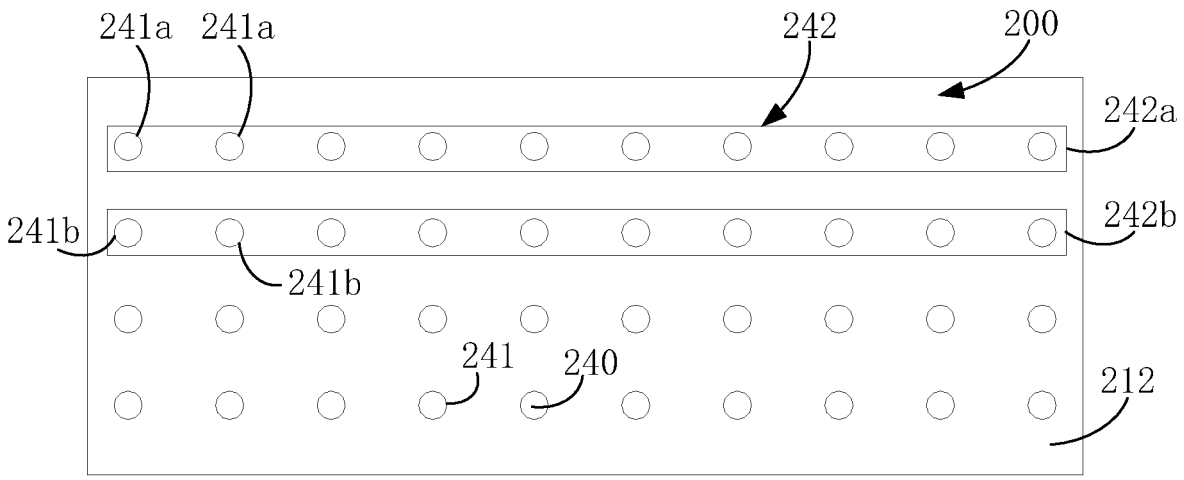
FIG. 4 is a top schematic view of the atomizing core shown in FIG. 3 according to a first example.
Figure 5:
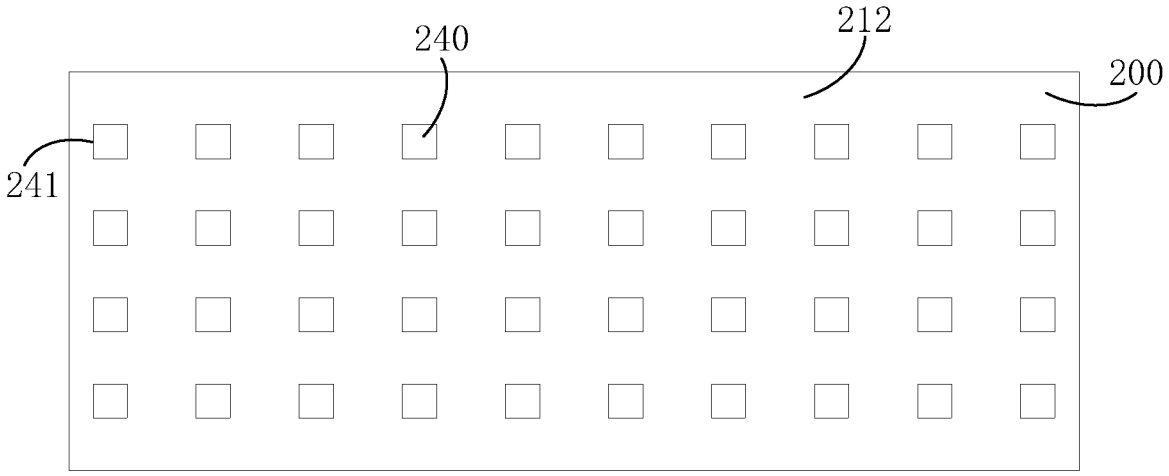
FIG. 5 is a top schematic view of the atomizing core shown in FIG. 3 according to a second example.
Figure 6:
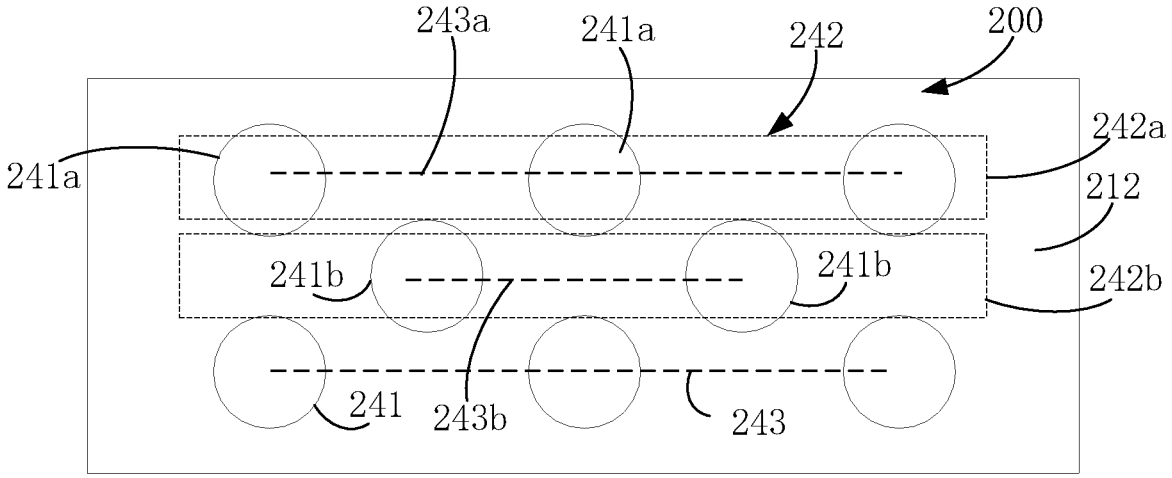
FIG. 6 is a top schematic view of the atomizing core shown in FIG. 3 according to a third example.

In some embodiments, the first surface 211 may be directly attached to the atomizing surface 110. A plurality of liquid guiding channels 230 are provided on the heating element 200. The liquid guiding channels 230 are in communication with outside and keep a set distance from the first surface 211. In other words, the liquid guiding channel 230 does not extend to the first surface 211, but causes the effect of extending through the first surface 211. The liquid guiding channel 230 may be a micro hole 240. A diameter of the micro hole 240 may be in a range from 0.005 mm to 0.5 mm. The micro hole 240 is a blind hole. An upper end of the micro hole 240 extends through the second surface 212 to be in communication with the outside. A lower end of the micro hole 240 is kept at a set distance from the first surface 211, to prevent the lower end of the micro hole 240 from extending through the first surface 211. In other words, each micro hole 240 can be regarded as being formed by a portion of the second surface 212 recessed toward the first surface 211 by a set depth. A cross section of the micro hole 240 can be in a regular or irregular shape such as circle, ellipse, rectangle, or regular polygon. Referring to FIGS. 4 and 6, when the cross section of the micro hole 240 is circular, the micro hole 240 is a circular hole. When the cross section of the micro hole 240 is in a shape of ellipse, the micro hole 240 is an elliptical hole. Referring to FIG. 5, when the cross section of the micro hole 240 is in a shape of square, the micro hole 240 is a square hole. By providing the micro holes 240, the heating element 200 can appear as a mesh-like structure in appearance.

Referring to FIGS. 3, 4, and 6, the upper ends of the micro holes 240 extend through the second surface 212 to form liquid outlets 241. The liquid outlets 241 are arranged on part of the second surface 212 to form multiple rows of outlet portions 242. In other words, one of the sections of the heating element 200 may be intercepted to form an intercepted section. The intercepted section of the heating element 200 may be in a shape of rectangular parallelepiped. Obviously, the part of the second surface 212 is located on the intercepted section, and the multiple rows of outlet portions 242 are also located on the interception section. In the outlet portions 242 in a same row, a connection line between centers of the respective liquid outlets 241 forms a straight segment 243. For example, for any two adjacent rows of outlet portions 242, one row of the outlet portions 242 are denoted as a first row outlet portion 242*a*, and the other row of the outlet portions 242 are denoted as a second row outlet portion 242*b*. Each liquid outlet 241 in the first row outlet portion 242*a* is denoted as a first liquid outlet 241*a*, and a connecting line between centers of the respective first liquid outlets 241*a* is denoted as a first straight segment 243*a*. Each liquid outlet 241 in the second row outlet portion 242*b* is denoted as a second liquid outlet 241*b*, and a connecting line between centers of the respective second liquid outlets 241*b* is denoted as a second straight segment 243*b*. The first straight segment 243*a* and the second straight segment 243*b* may be parallel to each other. It can be understood that the rows of the outlet portions 242 are arranged parallel to each other. That is, the micro holes 240 are arranged on at least part of the second surface 212 along multiple parallel lines. The first liquid outlets 241*a* and the second liquid outlets 241*b* may have same shapes and numbers. A distance between two adjacent first liquid outlets 241*a* is equal to a distance between two adjacent second liquid outlets 241*b*. The second liquid outlet 241*b* has an orthographic projection in a direction perpendicular to the second straight segment 243*b*. The orthographic projection can overlap with the first liquid outlet 241*a*. In this case, the first liquid outlet 241*a* and the second liquid outlet 241*b* are aligned with each other (see FIGS. 4 and 5). The orthographic projection can also be located between two adjacent first liquid outlets 241*a*. In other embodiments, the orthographic projection can further cover part of the first liquid outlet 241*a*. In this case, the first liquid outlet 241*a* and the second liquid outlet 241*b* are displaced with each other (see FIG. 6). In other words, the orthographic projections of any two adjacent rows of micro holes 240 in a column direction do not completely overlap with each other. Obviously, the column direction is a direction perpendicular to the above parallel lines.

Figure 7:
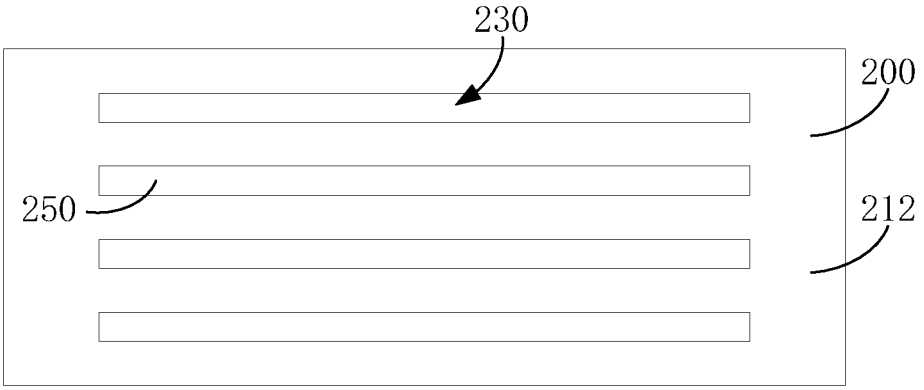
FIG. 7 is a partial top schematic view of the atomizing core shown in FIG. 1.
Figure 8:
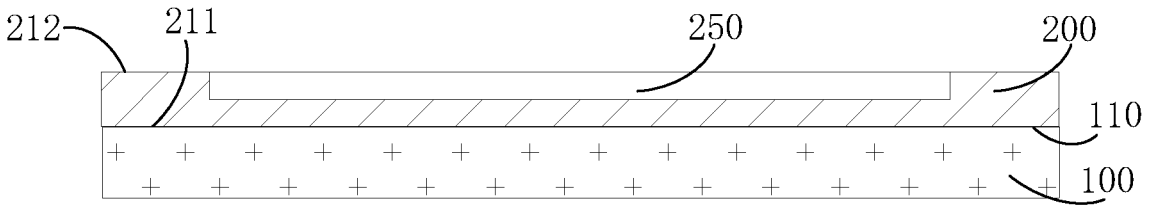
FIG. 8 is a cross-sectional schematic view of the atomizing core shown in FIG. 7.

Referring to FIGS. 7 and 8, in some embodiments, the liquid guiding channel 230 is an elongated groove 250. A length-width ratio of a cross section of the elongated groove 250 is greater than that of a cross section of the micro hole 240. The cross section of the elongated groove 250 can be rectangular or racetrack-shaped. A plurality of elongated grooves 250 are arranged at intervals on part of the second surface 212. In other words, one of the sections of the heating element 200 can be intercepted to form an intercepted section. The intercepted section of the heating element 200 may be in a shape of rectangular parallelepiped. Obviously, the part of the second surface 212 is located on the intercepted section. That is, the plurality of elongated grooves 250 are arranged at even intervals on the part of the second surface 212 located on the intercepted section.

Referring to FIG. 3, when an upper end of the liquid guiding channel 230 extends through the second surface 212, a depth h of the liquid guiding channel 230 can be in a range from 5 μm to 120 μm, for example, can specifically be 5 μm, 20 μm, 100 μm, or 120 μm. By reasonably setting the depth h of the liquid guiding channel 230, the depth h of the liquid guiding channel 230 is smaller than a thickness H of the heating element 200, so that the liquid guiding channel 230 cannot extend through the first surface 211, such that a lower end of the liquid guiding channel 230 is kept at a set distance from the first surface 211.

If the entire heating element 200 is not provided with any liquid guiding channel 230, that is, the heating element 200 is in a "fully dense state". Generally, in order to ensure that the heating element 200 has a certain strength and avoid the heating element 200 from being warped or wrinkled to be separated from the base 100 under the cyclic action of thermal stress, the heating element 200 will have a certain thickness. Therefore, the wettability of the heating element 200 is too low, such that it is difficult for the e-liquid on the base 100 to permeate the entire surface (for example, the second surface 212) of the heating element 200 having a certain thickness. When the heating element 200 is powered, a part of the surface of the heating element 200 that is not fully permeated by the e-liquid will have a local high temperature, which will cause dry burning to the heating element 200. Due to the dry burning, on the one hand, the e-liquid will produce a burnt smell due to the excessively high atomizing temperature, and the temperature of the aerosol formed by atomizing the e-liquid will be too high, resulting in a bad experience of oral burns. On the other hand, greater thermal stress will be generated at the part of the heating element 200 that is dry burned, which will cause the part of the heating element 200 to be warped and then separated from the base 100. In this case, the part of the heating element 200 separated from the base 100 will be more difficult to be permeated by the e-liquid, so that the part of the heating element 200 will be dry burned more seriously and generate toxic and irritating gases, thus causing a hazard to human health. In addition, more severe dry burning will cause the heating element 200 to be fused and unable to work normally, thereby shortening the service life of the heating element 200. Moreover, part of the heat generated by the heating element 200 cannot be used to atomize the e-liquid, and be wasted, thereby reducing the energy utilization rate of the heating element 200.

If the entire heating element 200 is provided with a liquid guiding structure that extends through both the first surface 211 and the second surface 212, the heating element 200 is in a "fully permeable state". In this case, the wettability of the heating element 200 is too high, and the e-liquid on the base 100 will quickly pass through the liquid guiding structure in the heating element 200 and directly permeate the entire surface of the heating element 200, causing the heating element 200 to be excessively permeated. As a result, on the one hand, a phenomenon of the e-liquid splashing occurs on the heating element 200 due to excessive e-liquid, so that the utilization rate of the e-liquid is low and the e-liquid is wasted. On the other hand, the temperature of the heating element 200 is too low, which results in a low temperature of the aerosol entering the user's mouth. In addition, the fragrance has an insufficient sense level. Due to the low heating temperature, the aerosol formed by atomizing the e-liquid has larger particles, which also affects the user experience.

As for the heating element 200 in the above embodiments of the present disclosure, the liquid guiding channel 230 only extends through the second surface 212, so that the liquid guiding channel 230 does not extend through the first surface 211 and is kept at a set distance from the first surface 211. In this case, the heating element 200 is in a "semi-permeable state". The liquid guiding channel 230 does not extend to the lower part of the heating element 200 adjacent to the first surface 211, so that the lower part of the heating element 200 is in a "fully dense state". In addition, the upper part of the heating element 200 adjacent to the second surface 212 is provided with the liquid guiding channel 230, such that the upper part of the heating element 200 is in a "fully permeable state". Therefore, the lower part in the "fully dense state" and the upper part in the "fully permeable state" are connected to form the heating element 200 in the "semi-permeable state". In this way, the wettability of the heating element 200 is neither too high nor too low, so as to ensure that the heating element 200 has reasonable wettability.

Therefore, the temperature generated by the heating element 200 in the "semi-permeable state" is lower than the temperature generated by the heating element 200 in the "fully dense state", to prevent the generation of the aerosol with excessively high temperature and the burning smell due to dry burning, and to avoid that the heating element 200 is separated from the base 100 and even fused due to dry burning, which improves the service life and safety of the heating element 200. In addition, the temperature generated by the heating element 200 in the "semi-permeable state" is higher than the temperature generated by the heating element 200 in the "fully permeable state", to prevent the aerosol with an excessively low temperature from being formed when the e-liquid is atomized, and ultimately, to ensure that the temperature of the aerosol is appropriate, neither too hot nor too cold. In addition, the fragrance of the aerosol has a certain sense level, and the aerosol has moderate particles, neither too large nor too small, which further improves the user experience.

Experiments show that when an input power is 6.5 W, the temperature generated by the heating element 200 in the "fully dense state" is in a range from 320° C. to 350° C., and the temperature generated by the heating element 200 in the "fully permeable state" is in a range from 250° C. to 290° C. The temperature generated by the heating element 200 in the "semi-permeable state" in the above embodiments is in a range from 290° C. to 320° C. Therefore, it is fully verified through experiments that the heating element 200 according to the above embodiments can generate an appropriate temperature, so as to avoid the aerosol from being too hot or cold.

It can be understood that by providing the liquid guiding channel 230, the resistance of the heating element 200 can also be increased. Under the same input power, the heating element 200 can generate more heat, and the e-liquid atomized per unit time is increased, thereby increasing the concentration of the aerosol. In addition, the liquid guiding channel 230 can cause the heating element 200 to have reasonable wettability, so that the thickness of the heating element 200 can be appropriately increased to increase its structural strength, preventing the heating element 200 from being warped or wrinkled under thermal stress, avoiding the heating element 200 from being fused due to dry burning and eliminating the generation of toxic gases, further improving the service life and safety of the heating element 200. The liquid in the liquid guiding channel 230 can also be atomized by the heating element 200, and the atomizing amount of the e-liquid and the concentration of the aerosol per unit time can also be increased.

Figure 9:
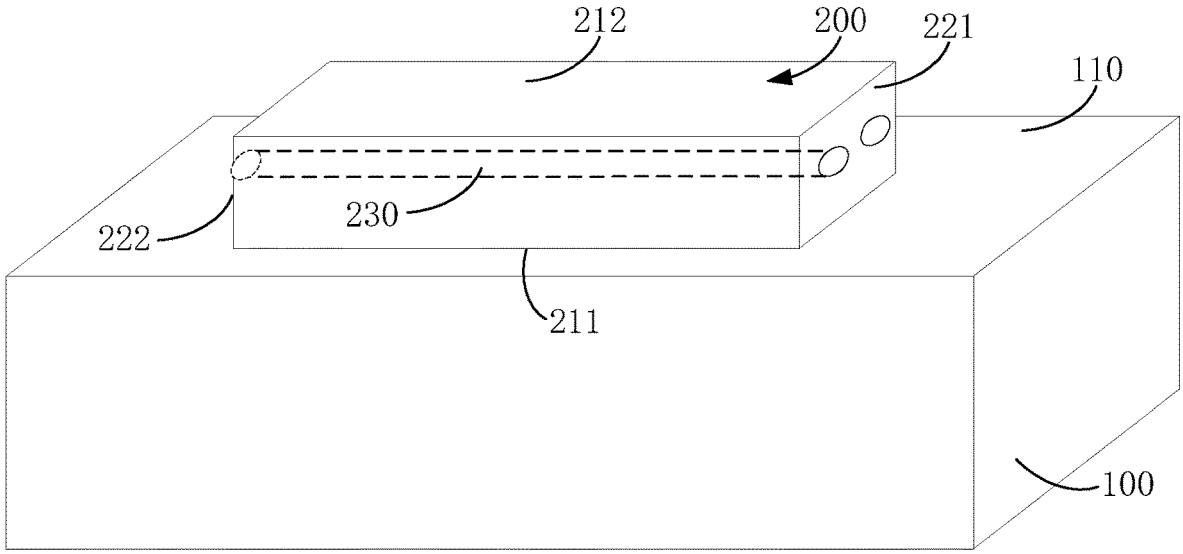
FIG. 9 is a partial perspective schematic view of the atomizing core shown in FIG. 1 according to a second example.

Referring to FIG. 9, in some embodiments, both ends of the liquid guiding channel 230 respectively extend through the first side surface 221 and the second side surface 222. In this case, the liquid guiding channel 230 can be regarded as a horizontally arranged liquid guiding channel 230. A central axis of the horizontally arranged liquid guiding channel 230 can be parallel to the first surface 211, and the liquid guiding channel 230 extending through the second surface 212 can be regarded as a vertically arranged liquid guiding channel 230. By arranging the liquid guiding channel 230 horizontally, the heating element 200 can also be in a "semi-permeable state". It is can be ensured that the heating element 200 can generate an appropriate temperature, and ensured that the aerosol is neither too hot nor too cold.

An extending path of the heating element 200 can be abstracted as a plane curve, in other words, the heating element 200 can be abstracted as a curve. The curve can be a spiral. The spiral can be similar to a rectangular spiral, or can be similar to an equidistant Archimedes spiral, a variable pitch involute spiral, an S-shaped spiral or the like.

The entire heating element 200 may be integrally formed. For example, the liquid guiding channel 230 is formed on the heating element 200 by means of laser engraving, chemical etching, or mechanical stamping. The heating element 200 can also be formed in separate parts. For example, the heating element 200 is divided into an upper part and a lower part. Firstly, the liquid guiding channel 230 is formed on the upper part by means of laser engraving, chemical etching, or mechanical stamping, such that the liquid guiding channel 230 extends through upper and lower surfaces of the upper part. Then, the upper part with the liquid guiding channel 230 is connected to the lower part by welding or injection molding.

The technical features of the above-described embodiments can be combined arbitrarily. To simplify the description, not all possible combinations of the technical features in the above embodiments are described. However, all of the combinations of these technical features should be considered as being fallen within the scope of the present disclosure, as long as such combinations do not contradict with each other.

The foregoing embodiments merely illustrate some embodiments of the present disclosure, and descriptions thereof are relatively specific and detailed. However, it should not be understood as a limitation to the patent scope of the present disclosure. It should be noted that, a person of ordinary skill in the art may further make some variations and improvements without departing from the concept of the present disclosure, and the variations and improvements falls in the protection scope of the present disclosure. Therefore, the protection scope of the present disclosure shall be subject to the appended claims.

What is claimed is:

1. An atomizing core, comprising:

a base made of a porous ceramic material and comprising an atomizing surface; and a heating element made of a metal alloy and disposed on the base, and capable of atomizing liquid on the atomizing surface;

wherein the heating element comprises a first surface that is in a thickness direction thereof and attached to the base, and the heating element is provided with liquid guiding channels that are in communication with outside the atomizing core and kept at a set distance from the first surface.

2. The atomizing core according to claim 1, wherein the heating element further comprises a second surface that is spaced apart from the first surface in the thickness direction thereof, and the second surface and the first surface face oppositely; the liquid guiding channels extend through the second surface and are in communication with outside.

3. The atomizing core according to claim 2, wherein the liquid guiding channels are micro holes, and a cross section of each of the micro holes is in a shape of circle, ellipse, rectangle, or regular polygon.

4. The atomizing core according to claim 3, wherein the micro holes are arranged on at least part of the second surface along a plurality of rows of parallel lines.

5. The atomizing core according to claim 4, wherein orthographic projections of any two adjacent rows of micro holes in a column direction do not completely overlap with each other; the column direction is a direction perpendicular to the parallel lines.

6. The atomizing core according to claim 2, wherein the liquid guiding channels are elongated grooves; a plurality of the elongated grooves are arranged at intervals on at least part of the second surface.

7. The atomizing core according to claim 2, wherein the heating element has a thickness is in a range from 10 μm to 150 μm; and a depth of the liquid guiding channel is in a range from 5 μm to 120 μm.

8. The atomizing core according to claim 1, wherein the heating element further comprises a first side surface and a second side surface that are arranged oppositely; the first surface is connected between the first side surface and the second side surface; and both ends of the liquid guiding channel extend through the first side surface and the second side surface, respectively.

9. The atomizing core according to claim 1, further comprising:

a first electrode connected to one end of the heating element; and a second electrode connected to the other end of the heating element.

10. The atomizing core according to claim 1, wherein the heating element is directly attached to the atomizing surface.

11. The atomizing core according to claim 1, wherein the atomizing surface is provided with a groove, and the heating element is entirely or partially accommodated in the groove.

12. An electronic atomizing device, comprising the atomizing core according to claim 1.

* * * * *